United States Patent [19]

Bekedam

[11] Patent Number: 4,878,457

[45] Date of Patent: Nov. 7, 1989

[54] ZERO FLASH CLOSED CONDENSATE BOILER FEEDWATER SYSTEM

[76] Inventor: Martin Bekedam, 103 Brookline, Moraga, Calif. 94556

[21] Appl. No.: 258,827

[22] Filed: Oct. 17, 1988

[51] Int. Cl.[4] ..... F22D 1/28; F22D 1/32; F22D 1/40

[52] U.S. Cl. ..... 122/441; 122/451.1; 122/451.2

[58] Field of Search ..... 122/412, 441, 442, 443, 122/451.1, 451.2

[56] References Cited

U.S. PATENT DOCUMENTS

| | | | |
|---|---|---|---|
| 2,644,308 | 7/1953 | Downs | 122/441 X |
| 2,656,823 | 10/1953 | Hillier | 122/441 |
| 2,885,790 | 5/1959 | Cram | 34/48 |
| 2,952,297 | 9/1960 | Hollis | 34/119 |
| 3,127,747 | 4/1964 | Peter | 122/441 X |
| 3,251,138 | 5/1966 | Whittaker | 34/48 |
| 3,802,499 | 4/1974 | Garcea | 165/163 |
| 4,637,350 | 1/1987 | Horibe et al. | 122/441 |
| 4,648,355 | 3/1987 | Bekedam | 122/412 |

FOREIGN PATENT DOCUMENTS

| | | |
|---|---|---|
| 500389 | 3/1939 | United Kingdom . |
| 854410 | 11/1960 | United Kingdom . |

*Primary Examiner*—Edward G. Favors
*Attorney, Agent, or Firm*—Bielen and Peterson

[57] ABSTRACT

A heat exchange system for steam returning from industrial processors to a pressurized receiver for return to a boiler with recovery of the thermal energy in the spent steam wherein the flow of water from a flash condenser connected to processor traps is regulated by the level of water in a water sink in the flash condenser for maximizing heat exchange and minimizing flash steam loss.

7 Claims, 1 Drawing Sheet

10
12
14
16
18
20
22
24
26
28
30
32
34
36
38
39
40
41
42
44
46
48
50
52
54
56
58
60
62
64
66
68
70
72
74
76
78
80
82
84
86
88
90

ZERO FLASH CLOSED CONDENSATE BOILER FEEDWATER SYSTEM

BACKGROUND OF THE INVENTION

This invention relates to heat recovery systems, and in particular to a closed condensate recovery system that is applied to high temperature steam processors such as corrugation machines, plywood dryers, paper mills and other industrial and agricultural processors where steam is generated by a boiler, used in a processor and collected as condensate in traps for recycling to the boiler. In many processes where steam is used as the primary medium for providing thermal energy to the process, the spent steam is desired to be recovered as condensate for recycling the boiler system. Because feedwater has to be specially prepared, minimizing the quantity of makeup water is economically desirable. Before being fed to a boiler, makeup water must be deaerated to remove as much trapped air as possible to prevent corrosion of the heat tubes of the boiler. Furthermore, because boiler makeup water is supplied at ambient air temperatures, substantial energy is required to preheat the makeup water to the desired circulating temperature of the return water system.

However, trapped condensate from the processing equipment must be reduced in pressure to reenter the boiler feedwater system. If the condensate from the processing equipment is trapped to atmosphere, in addition to the loss of flash steam, a substantial loss in thermal energy will occur in reducing the condensate to the atmospheric temperature of boiling, 212° F. Similarly, even if the trapped condensate is returned to a deaerator at 5 pounds internal pressure, significant loss of thermal energy and potential loss of flash steam will occur.

While substantial energy savings can be obtained by using heat exchanges for return of condensate to the feedwater system, for example as described in my U.S. Pat. No. 4,648,355, issued Mar. 10, 1987, entitled, HEAT EXCHANGER ARRAY FOR A STEP DOWN RETURN OF CONDENSATE, recovery can be improved by the flow system presently proposed.

In prior systems flow is conventionally regulated by pressure control valves which regulate water flows according to system pressures at various stages. Such systems are designed for optimized steady state conditions which are rarely encountered during normal operation of processing equipment. In addition to substantial variations in start up and shut down pressures and temperatures, fluctuations in steam quantity and in steam or vapor pressure during operation can result in disproportionate surges in water delivery circuits. In order to better coordinate and modulate the water return flow of the boiler feedwater, the zero flash closed condensate system of this invention was devised.

The latent energy in flashed steam is recovered in the final stage of heating the boiler feedwater in the flash condenser. Sensible heat from the return condensate is recovered in the intermediate stage of heating the boiler feedwater in the water to water heat exchanger. Finally, any residual energy from sensible or latent heat in the condensate on entry into the receiver is recovered by the receiver water. In this manner, all of the thermal energy in the higher temperature, higher pressure trapped condensate from the processing equipment is recovered.

SUMMARY OF THE INVENTION

The heat exchanger system of this invention comprises a zero flash, closed condensate system that is applied to industrial and agricultural processors such as a conventional corrugator. The corrugator, used as a example for this application, requires steam to be delivered at approximately 180 PSIG at 380° F. Spent steam is collected as condensate in traps in the processing equipment and returned to the feedwater system. In order to recover the thermal energy in the condensate, at least two thermal recovery components are utilized.

In the preferred embodiment disclosed, trapped condensate is delivered first to a flash condenser having a condensate surge tank for condensing flash steam, and, collecting and retaining a substantial quantity of the condensate at a lower temperature and pressure. From the flash condenser the condensate, as high temperature water, is delivered to a water to water heat exchanger for further reduction in temperature. From the heat exchanger the condensate is fed by a controlled delivery to a pressure receiver. The delivery is regulated by an electronically controlled valve governed by a level control in the surge tank of the flash condenser which actuates the valve releasing condensate when a designated level of condensate in the surge tank is reached. Pressure in the flash condenser is therefore allowed to vary within an acceptable range without affecting the more stable delivery of water from the surge tank to the heat exchanger. While some flashing may occur in the final delivery from the heat exchanger to the pressure receiver, such flashed steam is used to deaerate water in an associated deaerator. Auxiliary steam for such purpose may also be delivered from the boiler.

Because the deaerator is especially designed to vent entrapped non-condensible gases with minimum loss of steam, virtually no flash steam or condensate returned from the processor traps is lost from the system.

In the reverse direction of heat exchange, water from the pressure receiver, before being delivered to the boiler, is first circulated through the water to water heat exchanger and then to the flash condenser to recover the thermal energy lost by the trapped condensate during its return circuit. The feedwater is thereby substantially raised in temperature before being supplied to the boiler, resulting in substantial energy savings.

By assuring that the counter flow of condensate from the flash condenser is controlled by the water level in the condenser and not by internal condenser pressure, substantial surges caused by temporary pressure variations from the flash steam that could cause system blow down are avoided. By using the more stable level of water in the flash condenser surge tank, the return feed from the boiler is more closely associated with the supply feed to the boiler. This approximated balance between the feedwater and return water allows for a more uniform and consistent heat exchange in the exchange components. These and other features will become apparent from a consideration of the detailed description of the preferred embodiment.

DETAILED DESCRIPTION OF THE PREFERRED EMBODIMENTS

Figure 1:
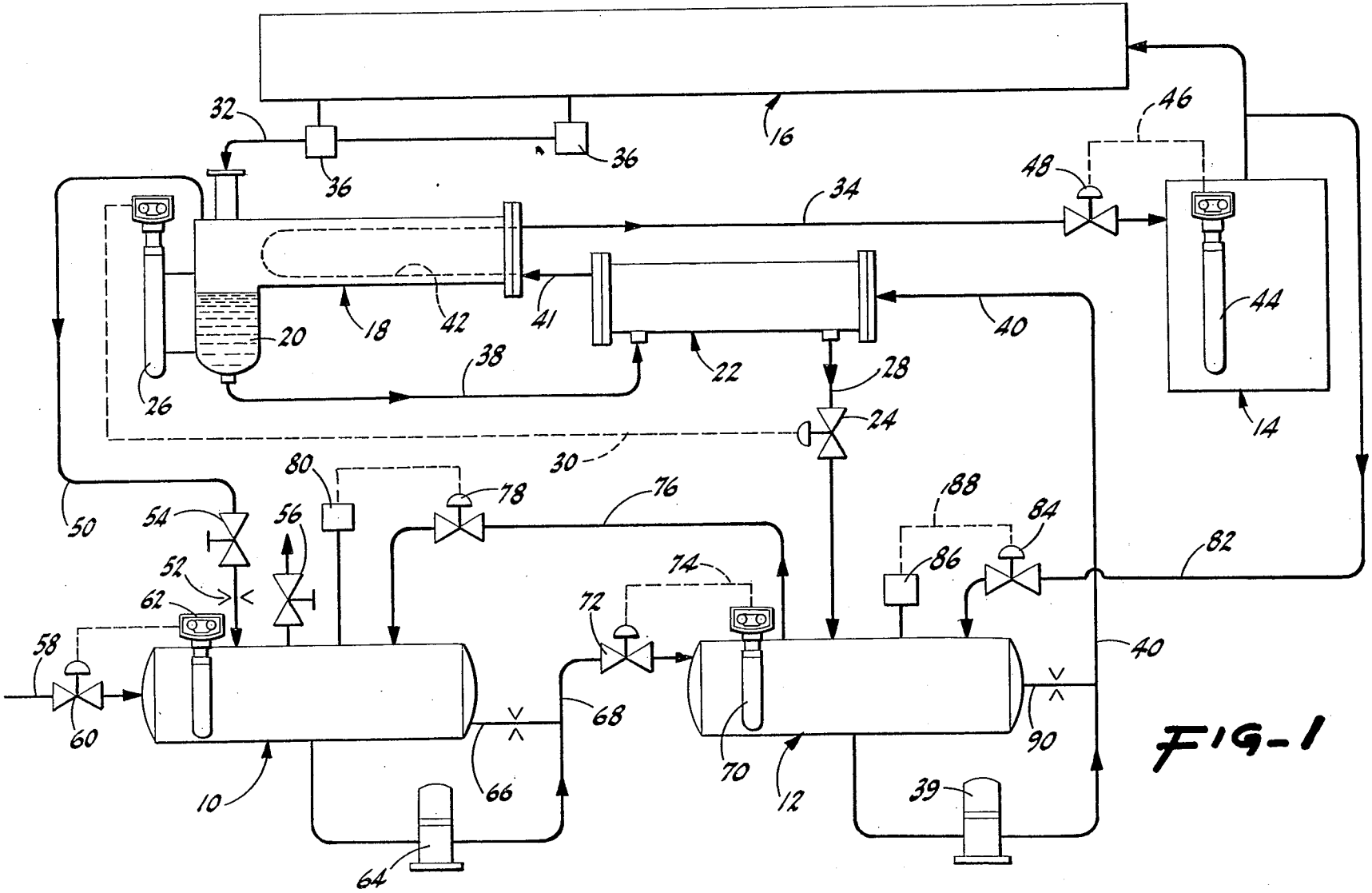
FIG. 1 is a schematic illustration of the zero flash close condensate system applied to an industrial corrugator.

Referring now to the schematic illustration of FIG. 1, the zero flash closed condensate system is illustrated in conjunction with exemplar processing equipment. For purposes of illustration, the processing equipment comprises a conventional corrugator for cardboard fabrication which requires steam delivery at approximately 180 PSIG at 380° F. Certain processing equipment such as plywood dryers require steamed delivery at higher temperatures and pressures and other processing equipment such as paper mill equipment may require steam to delivered at lower temperatures and pressures. The exemplar equipment is selected to show typical changes in temperature and pressure at various location in the component system. Accordingly, different temperatures and pressures will apply for the various types of processing equipment used.

The closed condensate system of this invention utilizes a conventional deaerator 10 and pressure receiver 12 which may be separate components as shown or combined into a single component, to return deaerated air from the pressure receiver 12 to a conventional industrial boiler 14. The boiler 14 supplies steam on demand to the corrugator equipment 16. Steam is delivered at 180 PSIG at 380° F.

Returning spent steam in the form of condensate from the corrugator equipment to the feedwater system for the boiler is somewhat complex because of the temperature and pressure of the condensate. As noted, if allowed to flash to atmosphere, substantial losses will result in thermal energy and condensate volume. Even trapping condensate to a deaerator that is operated at 5 pounds will result in thermal losses as well as escape of flash steam. With the closed condensate system proposed escape of flash steam is eliminated and efficient heat recovery is achieved.

Key to the closed condensate system is a flash condenser 18 with an internal surge tank 20 in combination with a water to water heat exchanger 22 wherein the flow of collected condensate in the surge tank through the heat exchanger is regulated by a valve 24 controlled by the water level in the surge tank 20 by means of a water level control 26. The regulator valve 24 is installed in the water flow line 28 between the heat exchanger 22 and the pressure receiver 12. In this manner, release of water from the flash condenser and heat exchanger combination is regulated according to the quantity of water collected in the surge tank. Regulator valve 24 is electronically controlled through electrical circuit 30, wherein the valve is activated releasing water by the level control 26, which senses that a predetermined level of water is reached. All regulator valves herein are similarly operated in this conventional manner.

Trapped condensate and any entrained flash steam from the corrugator 16, is delivered to the flash condenser through receiver line 32 where the condensate is cooled to approximately 320° F. by boiler feedwater circulating through the flash condenser through feedwater line 34. The pressure in the flash condenser ranges between 50 pounds to 75 pounds as condensate and flash steam are delivered from the corrugators to the condenser in varying quantities. Temperature of the collected condensate remains relatively stable however, due to the quantity of condensate retained in the surge tank. The surge tank 20 provides a stabilizing heat sink for collecting a quantity of water at substantially constant temperature during the irregular surges of condensate and steam delivered from the corrugator traps 36. Because the flow is regulated by the volume of water in the flash condenser and not the pressure of the vapor, such oscillations in pressure are not transmitted to the supply line 38 between the flash condenser and the heat exchanger as would be the case if the flash condenser were regulated by a pressure sensitive valve.

Heat of both the trapped condensate and flash steam from the corrugator is recovered in the boiler feedwater by raising the temperature of the feedwater from 240° F., the temperature of stored water in the pressure receiver, the 300° F., plus. This is accomplished by use of a standard boiler feed pump 39 which pumps water at the low receiver temperature through feed line 40 to the water to water heat exchanger 22 where it is raised in temperature by the previously described, counter flowing surge tank water from the flash condenser. The feedwater approximately is raised to 280° F. as it leaves the heat exchanger 22 and through feedwater line 41 enters the flash condenser 18 as the cooling fluid for the condenser cool in tube 42. In the flash condenser, the feedwater is further raised to 300° F. or above before being delivered through feedwater line 34 to the boiler 14. The feedwater supply is regulated by a water level control 44 electronically connected by line 46 to electronically controlled valve 48. Although substantially attenuated, there is some direct relationship between the boiler feedwater requirements and the flash condenser activity that provides a balance to the heat exchange system, wherein the quantity of feedwater delivered to the boiler is substantially equivalent to the condensate collected from the processor traps.

To prevent non-condensible gases from building up in the flash condenser, a gas dispeller line 50 connects the top of the flash condenser with the deaerator. The gas dispeller line 50 continuously bleeds carbon dioxide and other collected gases together with some minimum quantity of flash steam and delivers it through a constriction orifice 52 and regulator valve 54 to the deaerator 10 where it is continuously vented through valve controlled vent 56.

Since some steam is lost during the operation of the processing equipment, makeup water must be continually supplied to the deaerator through makeup line 58 as controlled by a regulator valve 60 monitored by the level control 62 in the deaerator 10. To continuously deaerate the water in the deaerator, a feed pump 64 is connected to a constricted recirculation line 66 which continuously returns water to the dearator 10. The feedwater pump 64 is also connected to a feed line 68 that is connected to the pressure receiver to deliver water from the deaerator to the receiver. Deaerated water is delivered to the pressure receiver 12 on demand as monitored by level control 70 that is connected to regulator valve 72 by electric line 74.

Steam to deaerate the circulating water is delivered from the pressure receiver through steam line 76 through electronically controlled regulator valve 78 that is controlled by pressure control 80 that maintains the deaerator at 5 pounds pressure and a corresponding 225° F. temperature. The steam supply line to the deaerator is positioned on top of the receiver such that any non-condensible gases such as air and carbon dioxide, that may be trapped in the pressure receiver are forced to return to the deaerator for deaerating.

The pressure receiver is maintained at 20 pounds pressure and 240° F. by steam from the boiler that is supplied through a supply line 82 that is regulated by regulator valve 84 controlled by the pressure control 86 through electric line 88. Steam obtained from the boiler to pressurize the receiver is minimized by some flashing of condensate from the water to water heat exchanger as it is delivered to the pressure receiver.

By use of the flash condenser and heat exchanger system to reduce temperature of the recovered condensate, a standard boiler feed pump that is rated under 250° F. can be utilized. The boiler feed pump which circulates the water in the pressure receiver through constricted line 90 is able to deliver feedwater to the boiler through supply line 40 on a relatively continuous bases without substantial surge demands. The feedwater to the boiler is raised from 240° F. to over 300° F. by passage through the heat exchanger and flash condenser before final delivery to the boiler.

Recovered flash steam and condensate from the corregator 16 is deaerated first in the flash condenser 18. Any residual non-condensible is then gas deaerated in the pressure receiver as the flash steam passes from the receiver to the deaerator transporting with it any entrained non-condensible gases. The continuous system counterflow of feedwater and return water thereby maximizes the heat exchange and minimizes the steam loss while affectively eliminating non-condensible gasses from the system.

While in the foregoing embodiments of the present invention have been set forth in considerable detail for the purposes of making a complete disclosure of the invention, it may be apparent to those of skill in the art that numerous changes may be made in such detail without departing form the spirit and principles of the invention.

What is claimed is:

1. A steam processing system having a closed condensate return system for collecting condensate from processing equipment and returning it to a boiler feedwater system comprising:

a boiler;

a boiler feedwater system having a low pressure receiver means for receiving condensate and storing boiler feedwater, and a feedwater delivery means for supplying feedwater from the receiver means to the boiler;

processing equipment that receives high pressure steam from the boiler, the processing equipment having collection means for collecting condensate from spent boiler steam;

a pressurized flash condenser connected to the processing equipment for receiving mid pressure condensate from the processing equipment, the flash condenser having a surge tank means for collecting condensate and a cooling means for circulating cooling water to condensate flash steam from condensate entering the flash condenser under varying pressure, wherein the cooling means of the flash condenser includes a cooling conduit through which the feedwater delivery means supplies feedwater from the receiver means to the boiler;

and, condensate return means for delivering condensate from the flash condenser to the receiver means according to the level of collected condensate in the flash condenser surge tank means.

2. The steam system of claim 1 wherein the condensate return means includes a level control means for sensing the level of condensate in the surge tank means, a condensate return line between the flash condenser and the receiver, and a regulator valve in the return line, the regulator valve being activated to release condensate from the surge tank means by the level control means when a predetermined level of water is reached in the surge tank.

3. The steam system of claim 2 comprising further a water to water heat exchanger wherein the feedwater delivery means is connected to the receiver means and to the boiler through the heat exchanger for raising the temperature of feedwater in the feedwater delivery means, and, the condensate return means is connected to the flash condenser and to the receiver means through the heat exchanger means for lowering the temperature of condensate in the condensate return means.

4. The steam system of claim 3 wherein the condensate return line connects the flash condenser to the heat exchanger and the heat exchanger to the receiver means and the regulator valve is located on the return line between the heat exchanger and the receiver means.

5. The steam system of claim 3 wherein the feedwater delivery means and the condensate return means are arranged to direct water through the heat exchanger in a counter current flow.

6. The steam system of claim 3 wherein the feedwater delivery means includes a boiler feed pump arranged between the heat exchanger and the receiver means.

7. The steam system of claim 1 wherein the receiver means includes a deaerator unit and the flash condenser has a top with a non-compressible gas bleed line connected between the top of the flash condenser and the deaerator unit.

* * * * *